US006811092B2

(12) United States Patent
Cowden

(10) Patent No.: US 6,811,092 B2
(45) Date of Patent: Nov. 2, 2004

(54) FUEL INJECTOR NOZZLE WITH PRESSURIZED NEEDLE VALVE ASSEMBLY

(75) Inventor: Gary L. Cowden, Lowell, MI (US)

(73) Assignee: Robert Bosch GmbH, Stuttgart (DE)

( * ) Notice: Subject to any disclaimer, the term of this patent is extended or adjusted under 35 U.S.C. 154(b) by 179 days.

(21) Appl. No.: 10/126,811

(22) Filed: Apr. 19, 2002

(65) Prior Publication Data

US 2003/0197067 A1 Oct. 23, 2003

(51) Int. Cl.[7] ..... F02M 47/02; F02M 39/00; B05B 1/30

(52) U.S. Cl. ..... 239/89; 239/88; 239/533.3; 239/585.1; 239/585.5

(58) Field of Search ..... 239/88, 89, 90, 239/91, 93, 95, 533.2, 533.3, 533.9, 533.8, 585.1, 585.2, 585.3, 585.4, 545.5; 251/129.15, 129.21

(56) References Cited

U.S. PATENT DOCUMENTS 4,527,738 A * 7/1985 Martin ..... 239/90
4,538,576 A * 9/1985 Schneider ..... 123/446
5,333,786 A * 8/1994 Gant et al. ..... 239/89
5,544,816 A 8/1996 Nally et al.
5,875,972 A 3/1999 Ren et al.
5,944,262 A 8/1999 Akutagawa et al.
5,954,487 A 9/1999 Straub et al.
5,967,424 A 10/1999 Bonnah, II
6,276,610 B1 8/2001 Spoolstra

* cited by examiner

*Primary Examiner*—Davis D Hwu
(74) *Attorney, Agent, or Firm*—Brooks Kushman P.C.

(57) ABSTRACT

A nozzle assembly for a fuel injector having a needle valve for controlling an injector valve orifice, the needle valve being subjected to a spring force and a fluid pressure force. The needle valve registers with a fuel delivery orifice and is movable into and out of engagement with a valve seat surrounding the orifice. The needle valve is normally biased to a valve closing position by a spring located in a spring cage. The spring cage becomes pressurized upon movement of the needle valve toward the needle valve open position, whereby a positive pressure is maintained in the spring chamber throughout the fuel injection event. A calibrated bleed orifice allows the spring chamber pressure to decay to a low value between injection events.

12 Claims, 5 Drawing Sheets

FUEL INJECTOR NOZZLE WITH PRESSURIZED NEEDLE VALVE ASSEMBLY

BACKGROUND OF THE INVENTION

1. Field of the Invention

The invention relates to fuel injectors for internal combustion engines and, particularly, to a needle valve assembly that forms a part of the injector.

2. Background Art

It is known practice in the design of fuel injectors for internal combustion engines, particularly diesel fuel engines, to provide an injector for each of multiple cylinders of the engines. The injector includes an injector needle valve assembly that receives pressurized fluid from a fuel injector pump, the pump in turn being driven by the engine camshaft whereby fuel injection pulses are delivered to the combustion chamber of the internal combustion engine cylinders for each engine cycle, i.e., a four-stroke engine cycle. The camshaft, which is driven at one-half engine speed, develops a pressure pulse during the injection phase of the four-stroke engine cycle.

A fuel injection plunger is driven by a cam follower that engages a cam surface on the engine camshaft. The plunger and its associated fuel cylinder define a fuel pumping chamber. A control valve assembly delivers fuel to the fuel chamber. The fuel supply for the control valve assembly is a low pressure fuel pump, which circulates fluid through the control valve at intervals in the engine cycle when the control valve is in an open position. When the valve is in a closed position, direct fluid communication between the fuel pump and the fuel pressure chamber is interrupted as the plunger is stroked during a fuel injection event. The timing of the opening and closure of the control valve is controlled by a solenoid actuator under the control of an electronic engine control system.

The fuel pressure chamber communicates with an injection nozzle orifice valve that registers with an injection orifice. Pressure developed in the fuel pressure chamber acts on a differential area on the needle valve to shift the needle valve to an open position during the injection event. Movement of the needle valve under pressure is opposed by a needle valve spring that normally tends to keep the needle valve closed.

The needle valve spring is situated in a spring cage, which forms a part of the fuel injector assembly. The needle valve has a stem that defines a guide surface.

In a conventional injector assembly, a small amount of fuel may leak back across the guide surface toward the spring cage as a pressure pulse is developed by the plunger. The fluid that is leaked toward the spring cage tends to pressurize the spring cage. To avoid a hydraulic lock of the needle due to a pressure buildup in the spring cage, the nozzle spring cage typically is vented to a low pressure region of the injector. The low pressure region communicates with the fuel supply, which is under much lower pressure than the injection pressure.

Because of the continuous venting of the spring cage, pressure fluctuation may occur in the vicinity of the spring cage during operation of a conventional fuel injector. This may result in fuel vapor formation as the needle valve is advanced to an injector orifice closing position. This creates a potential for cavitation to occur in the vicinity of the needle valve spring. After extended use, cavitation damage may occur due to the unfavorable low pressure condition within the cage due to needle valve movement. The damage caused by cavitation can result in a corrosive effect on the valve spring, which in turn may cause the spring to lose its calibrated spring characteristics. This in turn can adversely affect the characteristic shape of the pressure vs. timing function fuel injection pulses.

Examples of fuel injectors of known design may be seen by referring to U.S. Pat. Nos. 5,954,487 and 6,276,610, which are owned by the assignee of the present invention.

SUMMARY OF THE INVENTION

The fuel injector of the present invention includes a needle valve that controls distribution of fuel under pressure to the combustion chamber of an internal combustion engine, such as a diesel engine. A needle valve is urged by a needle valve spring to a fuel delivery orifice closing position. A valve stem, which defines a needle valve guide surface, is situated in a needle valve opening that includes a counterbore region in fluid communication with the spring cage when the needle valve is in a closed position.

When the injector plunger is stroked, pressure built up in the pressurized fuel pumping chamber is distributed to a differential area on the needle valve, thereby lifting the needle valve against the opposing force of the needle valve spring. When the needle valve is in its fully opened position, a sealing shoulder on the needle valve seals the spring cage, thereby maintaining an increased pressure developed in the spring cage as a result of the sudden volume reduction as the needle opens. The sealing shoulder is engageable with the spring cage to trap pressurized fuel in the spring cage during a fuel injection event.

When the needle valve, at the end of the fuel injection interval, moves to the orifice closing position, the spring cage is unsealed. The spring cage is depressurized at that time by fluid distributed through a fuel vent hole in the needle valve housing. The rate of pressure decay is controlled by appropriately sizing the fuel vent hole, the vent hole in turn communicating with low pressure regions of the injector. A sudden change to a negative pressure within the spring cavity due to movement of the needle valve to its valve closing position is avoided by this controlled pressure decay. A complete bleed-down of the trapped pressure in the spring cage will occur prior to the next injection event.

Because of the residual pressure maintained in the spring cage, fuel vapor is prevented from forming and the deleterious effect of cavitation in the spring cage is eliminated.

The presence of a positive pressure in the spring cage, furthermore, is beneficial because it provides an incremental closing force on the needle valve. In a conventional design, the only force acting on the needle valve to urge it to an orifice closing position is a spring force, which opposes the pressure in the fuel pumping chamber. This incremental closing force results in a higher initial closing pressure, which will reduce the closing time for the needle valve and establish a quicker termination of the fuel injection event. The rate of fuel delivery thus is more precisely controlled than in the case of a conventional injector design.

DETAILED DESCRIPTION OF THE PREFERRED EMBODIMENT(S)

Figure 1:
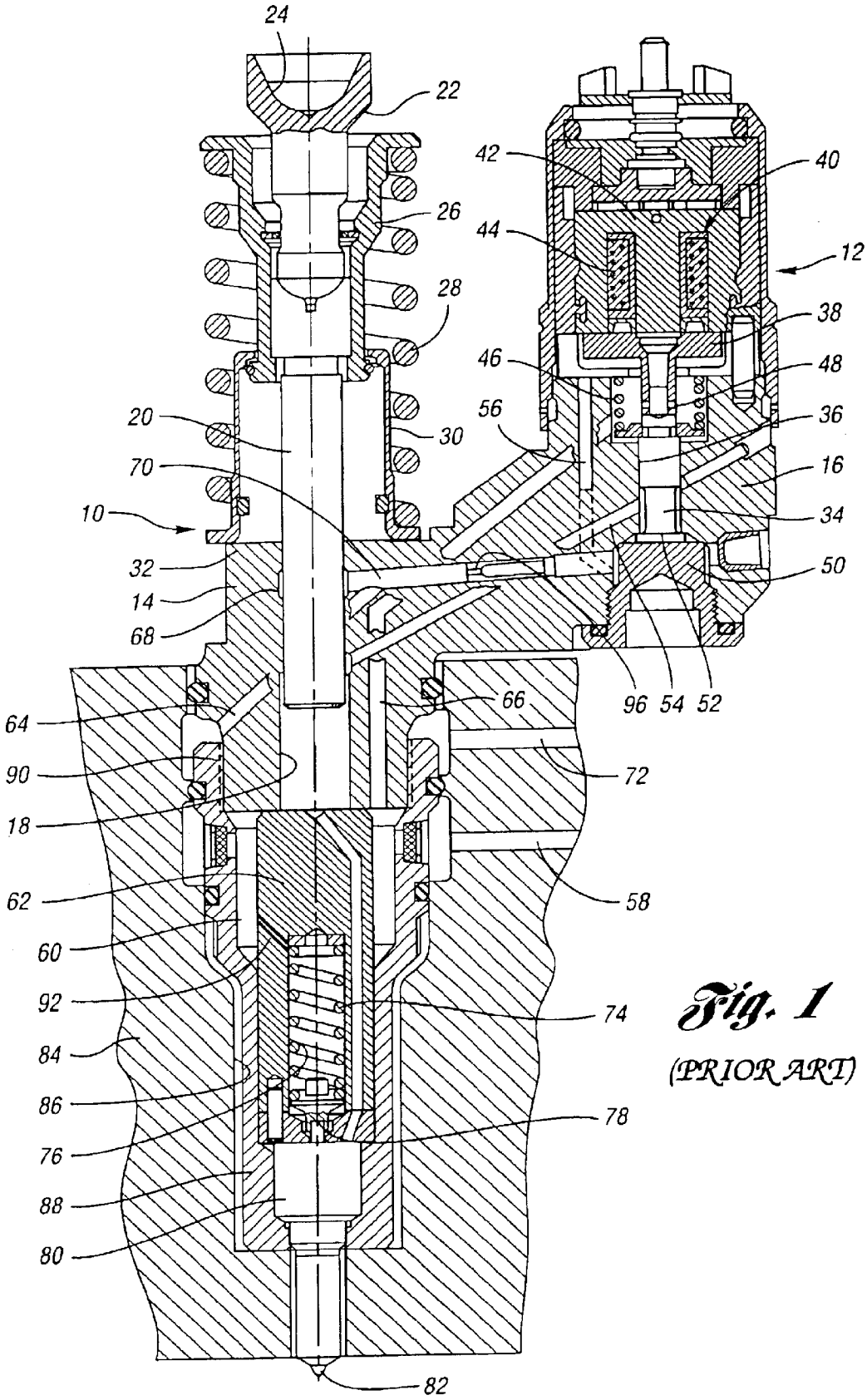
Fig. 1 (PRIOR ART)
FIG. 1 is a cross-sectional view of an injector of known design.

A conventional fuel injector is shown in FIG. 1. It comprises a pump unit 10 and a control valve assembly 12. The pump unit 10 may comprise a pump housing or body 14 that is integral with or that forms a part of housing or valve body 16 for the control valve assembly.

The pump housing or body 14 is provided with a cylinder which defines a high pressure fuel chamber 18 together with plunger 20. The upper end of the plunger 20 carries a cam follower 22 having a bearing pocket 24, which receives an actuator lever driven by the engine crankshaft.

A spring retainer 26 surrounds follower 22 and moves together with the follower 22 against the opposing force of follower spring 28. The lower end of the spring 28 surrounds the guide element 30, which is seated on a shoulder 32 on the pump body 14.

The valve assembly comprises a valve spool element 34 with a guide surface located in valve opening 36. Valve element 34 is connected to an armature 38 of an electromagnetic actuator 40. The actuator includes a stator 42 and an actuator coil 44. When the coil is energized, armature 38 engages the end face of the stator. This closes the valve element 34.

The valve element 34 is shifted in the opposite direction toward an open position by valve spring 46 situated in spring chamber 48 in the body 16. When the valve element 34 is shifted to the open position, its motion is limited by a control valve stop 50 threadably received in an opening in body 16.

The lower end of the valve element 34 is provided with an annular sealing shoulder 52. When the actuator is energized, shoulder 52 sealingly engages a valve seat formed in the body 16, which surrounds the valve chamber 36. The valve will seal high pressure fuel passage 54 from a low pressure opening occupied by the control valve stop 50. That low pressure opening communicates with spring chamber 48 and with a space in the body 16 below the armature 38. That communication is established by a low pressure passage 56.

Low pressure fuel supply passage 58 communicates with annular space 60 surrounding spring cage 62. Low pressure passage 64 communicates with the spring chamber 48, and the passage 58 communicates with low pressure passage 66, which extends directly to the spring chamber 48.

Any fluid that passes from the high pressure fuel pumping chamber 18 past the plunger 20 is received in an annular groove 68 and then drained through passage 70 to passage 64. Scavenger passage 72 communicates with passage 64.

Spring cage 62 forms a part of a nozzle assembly, which includes a needle valve spring 74 located in spring chamber 76 formed in the cage 62. The spring 76 engages the top of needle valve 78 received in a needle valve opening formed in nozzle assembly housing 80. The needle valve, as will be explained subsequently, opens and closes nozzle orifices at nozzle tip 82 situated in the fuel combustion chamber of the internal combustion engine. The cylinder head for the engine, which is identified by reference numeral 84, has recesses that receive the injector, one recess being shown at 86 in FIG. 1.

The nozzle assembly housing 80 is received in a nozzle nut 88, which in turn is received in the opening 86. The nozzle nut is threadably connected at 90 to the cylinder body 14.

In order to avoid a pressure buildup or a pressure lock in the spring chamber 76, an orifice 92 provides low pressure communication between the spring chamber 76 and the low pressure region 60, which, as explained, communicates with the low pressure fuel supply passage 58.

A spill orifice element 96 establishes a pressure differential between passage 56 and passage 70, the latter communicating with scavenger passage 72. Passage 72, in turn, communicates with the inlet side of a low pressure fuel pump, which supplies fluid to passage 58.

Figure 2:
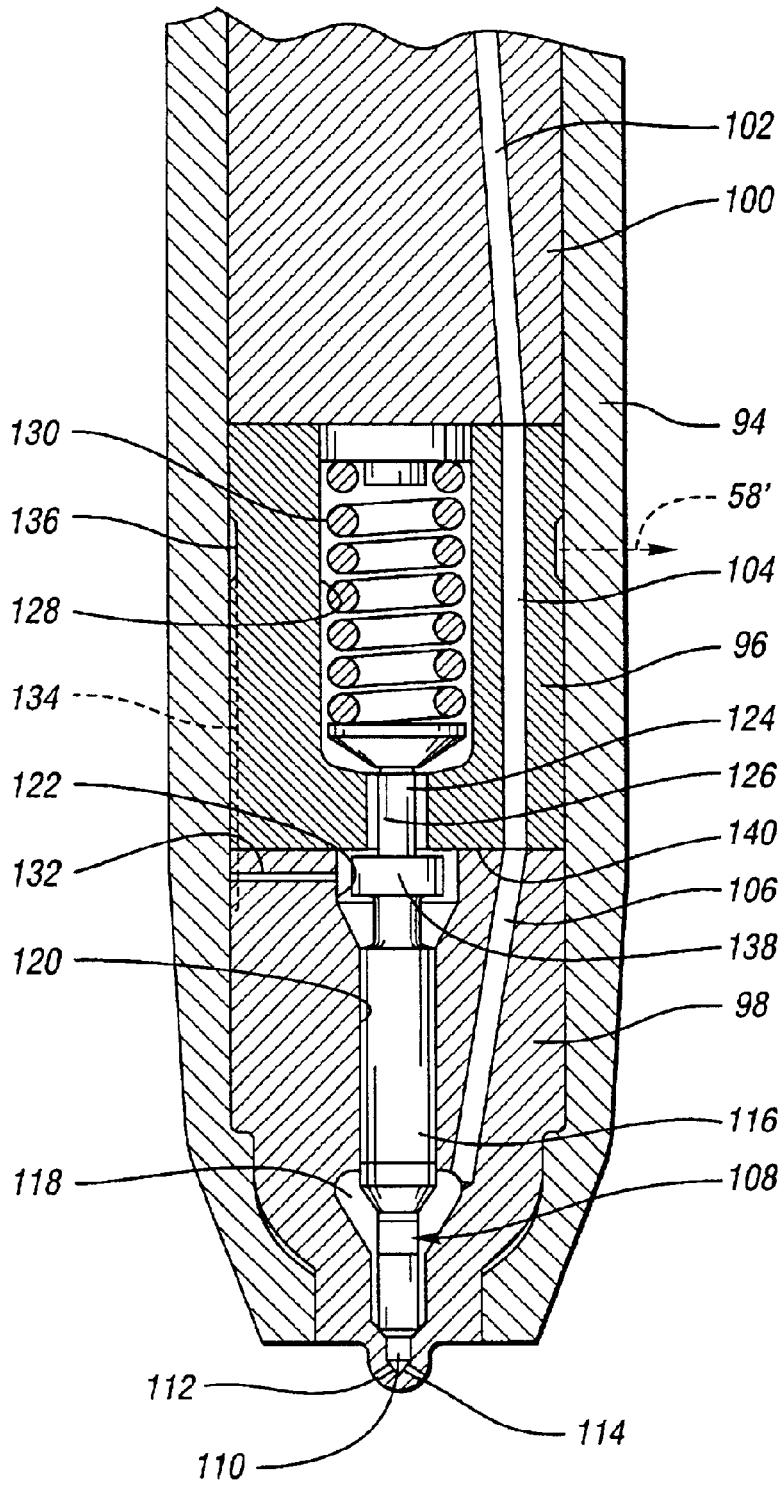
FIG. 2 is a cross-sectional view of the nozzle needle valve assembly for an injector that incorporates the present invention.

FIG. 2 shows an embodiment of the present invention which can be used in the environment illustrated in the conventional injector of FIG. 1. FIG. 2 shows a nozzle assembly comprising a nozzle nut 94 that encloses a spring cage 96 and a needle valve body 98. A cylindrical spacer 100 is situated on the upper side of the spring cage 96 between a plunger housing or body corresponding to the body 14 seen in FIG. 1. The nozzle nut 94 can be threadably connected to the plunger body in the manner shown at 90 in the embodiment of FIG. 1. In this way, the needle valve body, the spring cage and the spacer 100 are held in longitudinally stacked relationship as the nut 94 is tightened at its threaded connection with the plunger body.

A high pressure fuel chamber, corresponding to the high pressure fuel chamber 18 of FIG. 1, communicates with passage 102 in the spacer 100. Passage 104 in the spring cage 96 communicates with the passage 102 and with a high pressure fuel passage 106 formed in the needle valve body 98.

A needle valve, shown at 108, comprises a needle valve tip 110 that registers with injection orifices 112 when the needle valve is closed, thus interrupting the fuel pulse in the combustion chamber of the engine. Valve 108 comprises also a small diameter portion 114 and a larger diameter portion 116, which define a differential area that is subjected to the pressure in passage 106 when the plunger of the injector is stroked. The differential area is located in the cavity 118 in a needle valve opening in the needle valve housing 98. The large diameter portion 116 has a cylindrical guide surface that registers slidably with the cylindrical surface of needle valve opening 120.

The upper end of the opening 120 is enlarged, as defined by counterbore 122. A valve stem 124 extends through an opening 126 in the spring cage 96, thereby establishing communication between spring chamber 128 and the enlarged counterbore 122 of the needle valve chamber. Needle valve spring 130 is disposed in chamber 128 defined by the cage 96.

A bleed orifice 132 is formed in the needle valve body 98. It extends from the enlarged counterbore portion 122 of the needle valve chamber to a leak path shown in phantom at 134, which extends to a groove 136 formed in the spring cage 96. The groove 136 in turn communicates with a fuel supply and spill passage 58', which corresponds to the passage 58 in the embodiment of FIG. 1.

During the injection event, the plunger, as it is driven into the high pressure fuel pumping chamber of the injector, creates a high pressure at the differential area of the needle valve, which urges a shoulder 138 on needle valve 108 into sealing engagement with the lower surface 140 of the spring cage 96, thereby trapping fluid within the spring chamber 128. When the needle valve is fully opened, pressure is maintained in the needle valve chamber 128.

The pressure that exists is due to leakage past the needle valve into the enlarged area 122 creates a pressure in spring cage 96 during injection. Following injection, the fuel pressure trapped at an increased level in the spring cavity is allowed to decay at a rate that is controlled by the size of the calibrated vent hole 132 in the nozzle needle valve housing 98. The vent hole is sized such that the complete bleed-down of the trapped pressure occurs prior to the next injection event.

During the injection period, a positive pressure is maintained in the spring cage, which minimizes the opportunity for formation of fuel vapor near the spring, which in turn reduces cavitation damage. This positive pressure buildup prevents the formation of an unfavorable low pressure condition within the cage due to needle movement during the injection cycle.

Figure 2A:
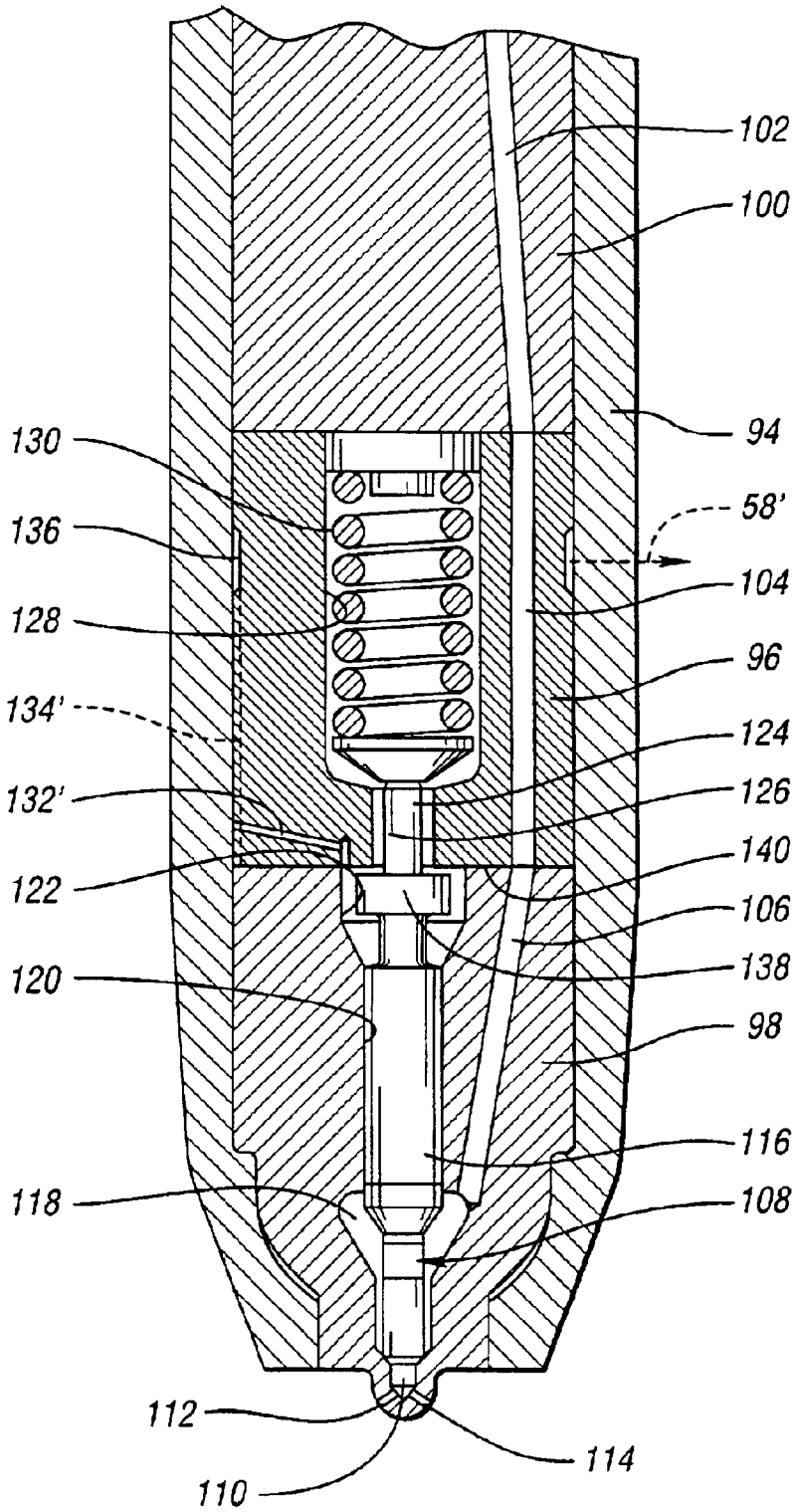
FIG. 2*a* is a cross-sectional view of a modified needle valve assembly corresponding to the needle valve assembly of FIG. 2.

FIG. 2*a* shows a modified nozzle assembly. It includes a bleed orifice 132' in the spring cage, which functions in a fashion similar to orifice 132 in the needle valve body 98 in FIG. 2. In other respects, the elements of the design of FIG. 2*a* may be the same as the corresponding elements of the design of FIG. 2. For this reason, the same reference numerals are used in each figure.

Figure 3A:
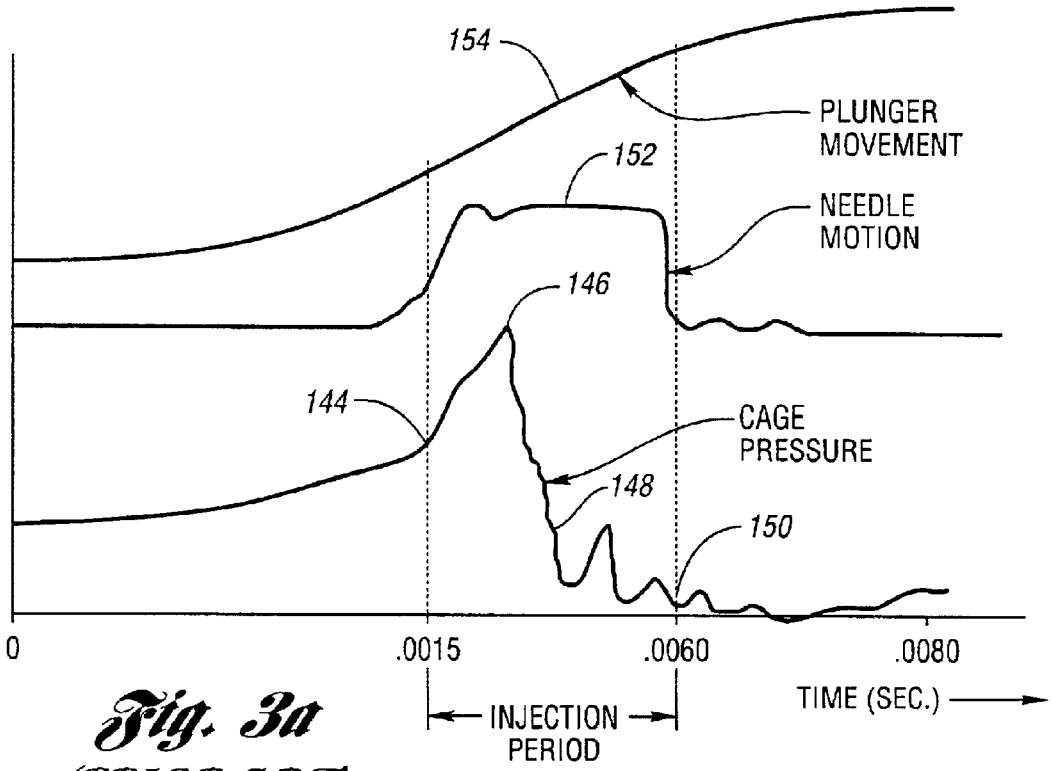
Fig. 3a (PRIOR ART)
FIG. 3*a* is a plot of the cage pressure, the needle valve movement and the plunger movement versus time during the injection period for an injector of the type shown in FIG. 1.

FIG. 3*a* shows the pattern of the pressure change within the cage for a conventional design, such as that shown in FIG. 1. As the injection period begins at the instant indicated at 144, the pressure will rise to a peak as shown at 146. This is followed by a rapid cage pressure decline, as shown at 148. During the period between the peak pressure at 146 and the end of the injection period shown by baseline curve 150, the needle valve will move, thereby creating the possibility of fuel vapor formation and cavitation within the spring cavity.

The pattern of motion of the needle plotted against time is shown at 152, and plunger movement is shown at 154. Movement of the needle valve, as indicated in FIG. 3*a*, will occur when the pressure within the cage is relatively low.

Figure 3B:
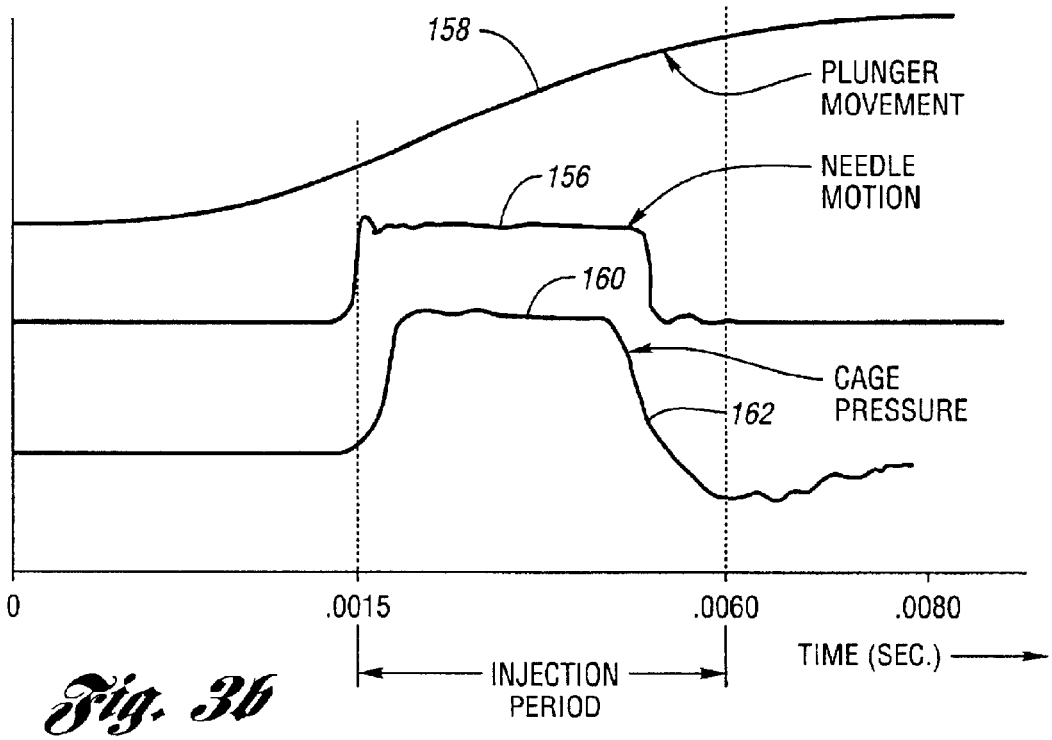
FIG. 3*b* is a plot corresponding to the plot of FIG. 3*a* showing the extended, relatively continuous cage pressure valve throughout a major portion of the injection period, together with a plot showing needle valve movement and plunger movement during the injection period.

In contrast to the characteristics shown in FIG. 3*a*, FIG. 3*b* shows the comparable characteristics of an injector that incorporates the present invention of FIGS. 2 and 2*a*. The needle motion and the plunger movement, indicated respectively at 156 and 158 in FIG. 3*b*, is generally similar to the corresponding needle motion and plunger movement plots of FIG. 3*a*. The cage pressure plot of FIG. 3*b*, however, is substantially altered because of the ability of the nozzle design of the present invention to maintain a pressure within the spring cavity during the injection period. The cage pressure, as indicated in FIG. 3*b* at 160, is relatively high until the end of the injection period is approached. At that time, needle motion occurs when the cage pressure is relatively high so that the cage pressure will decay as indicated by the curve shown at 162. By comparison, the cage pressure curve 148 of the prior art example will decrease to a negative valve just before the end of the injection period. The particular curve that represents the decay will depend upon the orifice characteristics that are designed. In general, the orifice characteristics ensure that adequate cage depressurization will occur prior to the next injection event.

Figure 3C:
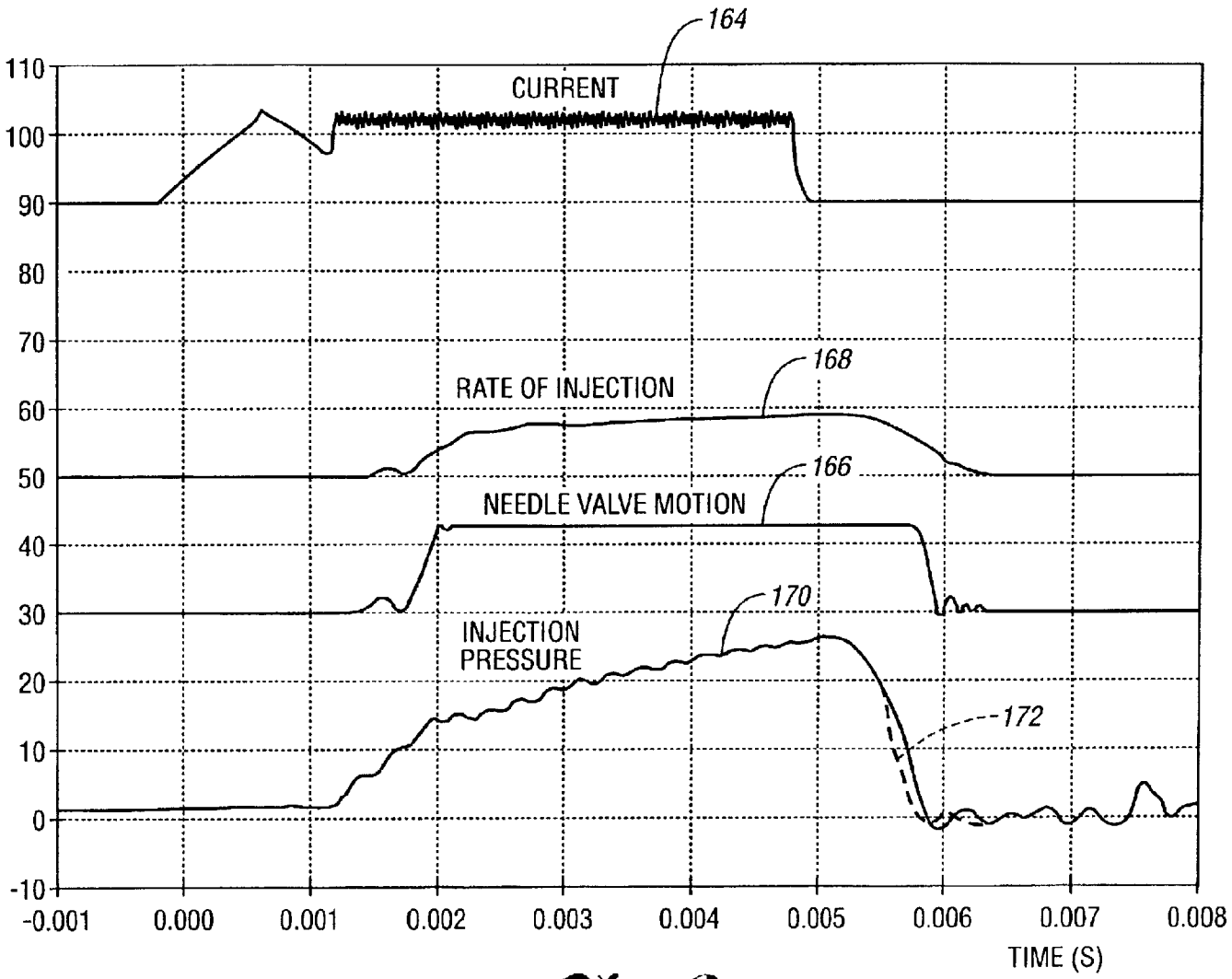
FIG. 3*c* is a plot showing injection pressure, needle valve motion, rate of injection, valve motion and actuator solenoid current versus time for the injector of the present invention.

Other characteristics of the nozzle design of the present invention are illustrated in FIG. 3*c*. During the injection event, which takes place, for example, between time .0015 sec. and .006 sec., the current in the stator windings is plotted at 164. This current corresponds to the current that would exist at the windings 44 in the embodiment of FIG. 1. The valve motion is shown at 166 in FIG. 3*c*, and the rate of injection is shown at 168 during the injection event. As seen in the baseline plot at 170, the injection pressure builds up during the injection event as the plunger is stroked in a downward direction. The injection pressure decays at an increased rate as shown at 172 at the end of the injection event.

Aside from the reduction or elimination of cavitation in the spring cavity, the present invention makes it possible for a more rapid closure of the needle valve at the end of the injection event. This is due to the fact that the pressure buildup in the spring cage will complement the force of the needle valve spring 130. The precise closing of the needle valve will permit more precise calibration of the pressure pulse pattern developed by the injector.

Although embodiments of the invention have been particularly disclosed, it will be apparent to persons skilled in the art that modifications to those embodiments may be made without departing from the scope of the present invention. All such modifications and equivalents thereof are intended to be covered by the following claims.

What is claimed is:

1. A fuel injector for an internal combustion engine comprising:

a cylinder housing defining a cylinder opening;

a pump plunger in the cylinder housing defining a high pressure fuel pumping chamber, an engine camshaft follower connected to the plunger;

a plunger spring urging the plunger in a direction to increase the volume of the high pressure fuel pumping chamber, the camshaft follower driving the plunger against the force of the plunger spring to create an injection pressure in the fuel pumping chamber;

a needle valve body having a needle valve opening;

a fuel delivery orifice in the needle valve body, the needle valve closing the fuel delivery orifice when it is moved to a closed position;

a needle valve spring urging the needle valve to the closed position;

a spring cage enclosing the needle valve spring, the spring cage being in fluid communication with the needle valve opening when the needle valve is in a closed position;

a sealing shoulder on the needle valve that is engageable with the spring cage to trap pressurized fuel in the spring cage during a fuel injection event; and a calibrated fuel vent in communication with the needle valve opening whereby pressurized fuel in the spring cage is discharged to a low pressure region of the injector when a fuel injection event is completed, the presence of pressurized fluid in the spring chamber reducing a tendency for cavitation to occur upon movement of the needle valve.

2. The fuel injector set forth in claim 1 wherein the needle valve, when it is in an open orifice position, has a pressure area that is pressurized by cage pressure in the spring chamber, whereby the needle valve is closed under the force of the needle valve spring supplemented by a pressure force created by cage pressure.

3. The fuel injector set forth in claim 2 wherein the calibrated fuel vent comprises an orifice in the spring cage, which discharges pressurized fluid in the spring chamber at a controlled rate whereby cage pressure is maintained at a high level throughout an injection event and cage pressure decays following the injection event.

4. The fuel injector set forth in claim 2 wherein the calibrated fuel vent comprises an orifice in the needle valve body, which discharges pressurized fluid in the spring chamber at a controlled rate whereby cage pressure is maintained at a high level throughout an injection event and cage pressure decays following the injection event.

5. The fuel injector set forth in claim 1 wherein the calibrated fuel vent comprises an orifice in the spring cage, which discharges pressurized fluid in the spring chamber at a controlled rate whereby cage pressure is maintained at a high level throughout an injection event and cage pressure decays following the injection event.

6. The fuel injector set forth in claim 1 wherein the calibrated fuel vent comprises an orifice in the needle valve body, which discharges pressurized fluid in the spring chamber at a controlled rate whereby cage pressure is maintained at a high level throughout an injection event and cage pressure decays following the injection event.

7. A fuel injector for an internal combustion engine comprising:

a cylinder housing defining a cylinder opening;

a pump plunger in the cylinder housing defining a high pressure fuel pumping chamber, an engine camshaft follower connected to the plunger;

a plunger spring urging the plunger in a direction to increase the volume of the high pressure fuel pumping chamber, the camshaft follower driving the plunger against the force of the plunger spring to create an injection pressure in the fuel pumping chamber;

a needle valve body having a needle valve opening;

a fuel delivery orifice in the needle valve body, the needle valve closing the fuel delivery orifice when it is moved to a closed position;

a needle valve spring urging the needle valve to the closed position;

a spring cage enclosing the needle valve spring, the spring cage being in fluid communication with the needle valve opening when the needle valve is in a closed position;

a sealing shoulder on the needle valve that is engageable with the spring cage to trap pressurized fuel in the spring cage during a fuel injection event; and a calibrated fuel vent in communication with the needle valve opening whereby pressurized fuel in the spring cage is discharged to a low pressure region of the injector when a fuel injection event is completed, the presence of pressurized fluid in the spring chamber reducing a tendency for cavitation to occur upon movement of the needle valve, the needle valve body comprising a first body portion defining the spring cage and a second body portion defining the needle valve opening;

a nozzle nut surrounding the first and second body portions; and a releasable connection between the nozzle nut and the cylinder housing whereby the cylinder housing and the first and second body portions are held in stacked, assembled relationship.

8. The fuel injector set forth in claim 7 wherein the calibrated fuel vent comprises an orifice in the spring cage, which discharges pressurized fluid in the spring chamber at a controlled rate whereby cage pressure is maintained at a high level throughout an injection event and cage pressure decays following the injection event.

9. The fuel injector set forth in claim 7 wherein the calibrated fuel vent comprises an orifice in the needle valve body, which discharges pressurized fluid in the spring chamber at a controlled rate whereby cage pressure is maintained at a high level throughout an injection event and cage pressure decays following the injection event.

10. A fuel injector for an internal combustion engine comprising:

a cylinder housing defining a cylinder opening;

a pump plunger in the cylinder housing defining a high pressure fuel pumping chamber, an engine camshaft follower connected to the plunger;

a plunger spring urging the plunger in a direction to increase the volume of the high pressure fuel pumping chamber, the camshaft follower driving the plunger against the force of the plunger spring to create an injection pressure in the fuel pumping chamber;

a needle valve body having a needle valve opening;

a fuel delivery orifice in the needle valve body, the needle valve closing the fuel delivery orifice when it is moved to a closed position;

a needle valve spring urging the needle valve to the closed position;

a spring cage enclosing the needle valve spring, the spring cage being in fluid communication with the needle valve opening when the needle valve is in a closed position;

a sealing shoulder on the needle valve that is engageable with the spring cage to trap pressurized fuel in the spring cage during a fuel injection event; and a calibrated fuel vent in communication with the needle valve opening whereby pressurized fuel in the spring cage is discharged to a low pressure region of the injector when a fuel injection event is completed, the presence of pressurized fluid in the spring chamber reducing a tendency for cavitation to occur upon movement of the needle valve, the needle valve body comprising a first body portion defining the spring cage and a second body portion defining the needle valve opening;

the needle valve, when it is in an open orifice position, having a pressure area that is pressurized by cage pressure in the spring chamber, whereby the needle valve is closed under the force of the needle valve spring supplemented by a pressure force created by cage pressure;

a nozzle nut surrounding the first and second body portions and a releasable connection between the nozzle nut and the cylinder housing whereby the cylinder housing and the first and second body portions are held in stacked, assembled relationship.

11. The fuel injector set forth in claim 10 wherein the calibrated fuel vent comprises an orifice in the spring cage, which discharges pressurized fluid in the spring chamber at a controlled rate whereby cage pressure is maintained at a high level throughout an injection event and cage pressure decays following the injection event.

12. The fuel injector set forth in claim 10 wherein the calibrated fuel vent comprises an orifice in the needle valve body, which discharges pressurized fluid in the spring chamber at a controlled rate whereby cage pressure is maintained at a high level throughout an injection event and cage pressure decays following the injection event.

* * * * *